US009874044B2

(12) United States Patent
Medawar

(10) Patent No.: US 9,874,044 B2
(45) Date of Patent: Jan. 23, 2018

(54) STORAGE CASE WITH LOCKING MECHANISM

(71) Applicant: Samuel C. Medawar, Lansing, MI (US)

(72) Inventor: Samuel C. Medawar, Lansing, MI (US)

( * ) Notice: Subject to any disclaimer, the term of this patent is extended or adjusted under 35 U.S.C. 154(b) by 0 days.

(21) Appl. No.: 15/381,958

(22) Filed: Dec. 16, 2016

(65) Prior Publication Data

US 2017/0175422 A1 Jun. 22, 2017

Related U.S. Application Data

(60) Provisional application No. 62/267,978, filed on Dec. 16, 2015.

(51) Int. Cl.

| | |
|---|---|
| ***E05B 65/46*** | (2017.01) |
| ***E05B 65/00*** | (2006.01) |
| ***E05C 3/12*** | (2006.01) |
| ***E05C 9/00*** | (2006.01) |
| ***E05C 9/10*** | (2006.01) |
| ***E05C 19/00*** | (2006.01) |
| ***E05C 19/12*** | (2006.01) |
| ***E05B 15/00*** | (2006.01) |
| ***E05B 65/06*** | (2006.01) |
| ***E05G 1/04*** | (2006.01) |
| ***E05C 7/04*** | (2006.01) |

(52) U.S. Cl.

CPC ..... *E05B 65/0003* (2013.01); *E05B 15/0053* (2013.01); *E05B 65/0075* (2013.01); *E05B 65/06* (2013.01); *E05C 3/12* (2013.01); *E05C 7/04* (2013.01); *E05C 9/006* (2013.01); *E05C 9/10* (2013.01); *E05C 19/001* (2013.01); *E05C 19/12* (2013.01); *E05G 1/04* (2013.01)

(58) Field of Classification Search

CPC .. E05B 65/0003; E05B 65/0075; E05B 65/06; E05B 15/0053; E05C 3/12; E05C 7/04; E05C 9/006; E05C 9/10; E05C 19/001; E05C 19/12; E05G 1/04

See application file for complete search history.

(56) References Cited

U.S. PATENT DOCUMENTS 1,675,085 A * 6/1928 Bartels ..... E05B 65/0075 292/337
1,870,746 A * 8/1932 Pyle ..... E05B 65/0075 109/59 R (Continued)

*Primary Examiner* — Hanh V Tran

(74) *Attorney, Agent, or Firm* — The Weintraub Group, PLC

(57) ABSTRACT

The present invention provides a locking mechanism for particular use in securing doors of a storage safe. The locking mechanism, generally, includes an elongated band, at least one plate rotatably connected to the elongated band, and at least one rod rotatably connected to the at least one plate. The locking mechanism further includes means for actuating for actuating the locking mechanism, the means for actuating being operable between a locking and an unlocking position for translating the elongated band. A stabilizing member ensures that the at least one rod maintains a substantially horizontal position and engages a receptor on an opposed door of the storage safe, thereby locking the doors when in a closed position.

9 Claims, 4 Drawing Sheets

(56) References Cited

U.S. PATENT DOCUMENTS 2,039,124 A * 4/1936 Stryker ..... B60N 2/3013 16/230
2,887,965 A * 5/1959 Henkel ..... E05B 65/0075 109/59 R
2,996,322 A * 8/1961 McClellan ..... E05B 65/0082 109/59 R
4,468,943 A * 9/1984 Beattie ..... E05B 65/0075 292/36
4,926,762 A * 5/1990 Paul ..... B60R 7/087 109/23
5,094,483 A * 3/1992 James ..... E05B 65/0075 109/59 R
5,267,688 A * 12/1993 Benefield ..... A47G 29/1201 232/17
5,597,187 A * 1/1997 Hjorth ..... E05B 15/0006 292/137
5,733,021 A * 3/1998 O'Neill ..... A47F 3/002 312/114
6,474,248 B1 * 11/2002 Stark ..... E05B 13/005 109/59 R
6,554,326 B1 * 4/2003 Goldman ..... E05B 47/0002 292/144
6,851,770 B2 * 2/2005 Canedy ..... A47F 3/002 312/114
7,428,873 B1 * 9/2008 Searle ..... E05G 1/005 109/24
7,464,570 B1 * 12/2008 Chen ..... E05B 43/005 109/59 R
8,117,973 B1 * 2/2012 Frank ..... E05G 1/005 109/47
9,394,714 B1 * 7/2016 Willsey ..... E04H 9/14
9,540,843 B2 * 1/2017 Garrett ..... E05C 5/04
9,663,974 B2 * 5/2017 Savage ..... E05B 65/025
2003/0079663 A1 * 5/2003 Suggs ..... E05B 65/0075 109/59 R
2003/0221596 A1 * 12/2003 Guinan ..... E05B 63/0004 109/24.1
2005/0035194 A1 * 2/2005 Mercer ..... E05B 65/0075 235/379
2005/0121509 A1 * 6/2005 McCracken ..... E05B 65/0075 235/379
2005/0138975 A1 * 6/2005 Cline ..... E05B 63/0043 70/63
2005/0193932 A1 * 9/2005 Denison ..... E05B 47/0012 109/59 R
2007/0046032 A1 * 3/2007 Moore ..... E05B 13/001 292/36
2007/0194674 A1 * 8/2007 Salter ..... A47F 3/002 312/312
2007/0261450 A1 * 11/2007 Kim ..... E05B 65/0075 70/283
2008/0079337 A1 * 4/2008 Vardaro ..... A47F 3/002 312/138.1
2008/0174215 A1 * 7/2008 Amstutz ..... A47F 3/002 312/117
2009/0127991 A1 * 5/2009 Reuter ..... E05B 53/00 312/326
2010/0031857 A1 * 2/2010 Dunstan ..... E05B 47/0673 109/74
2011/0083591 A1 * 4/2011 Stepp ..... E05B 65/0075 109/64
2011/0174025 A1 * 7/2011 Rasmussen ..... E05B 47/0673 70/91
2015/0332528 A1 * 11/2015 McGinnis ..... E05B 65/0075 109/38

* cited by examiner

STORAGE CASE WITH LOCKING MECHANISM

CROSS-REFERENCE TO RELATED APPLICATIONS

This application is a completion application which claims the priority benefit of U.S. Provisional Patent Application Ser. No. 62/267,978, filed Dec. 16, 2015, for "Locking Mechanism," the entire disclosure of which is hereby incorporated by reference in its entirety, including the drawing.

BACKGROUND OF THE INVENTION

1. Field of the Invention

The present invention pertains to a locking mechanism. More particularly, the present invention pertains to a security locking mechanism for securing door panels together. Even more particularly, the present invention concerns a locking mechanism for a combined display case and storage safe.

2. Description of Prior Art

Display cases are widely known for use in displaying high-value articles such as jewelry, coins, watches, cameras, and the like. A typical display case has one or more glass windows and, thus, is particularly susceptible to theft when a criminal smashes the glass and removes as many valuable articles as possible before escaping.

Oftentimes, retailers will remove high-value items daily from their display cases at the close of business and relocate the merchandise into more secure storage or vault. This routine transfer of goods between the display case and a security storage vault increases the cost of labor required to relocate display items at the beginning and end of each business day. Other problems may result from having to relocate merchandise including possible wear and tear on the merchandise and display fixtures, in addition to issues regarding inventory and loss control.

An example of an apparatus related to a security display case is disclosed in Sands, EP 0521728A1, for a Security Receptacle. While the reference teaches a safe for concealing valuable items, it fails to teach the specifics of a locking mechanism other than doors fitted with conventional locks and bolts.

Furthermore, in U.S. Pat. Nos. 9,078,531 and 9,512,663, the entire disclosures of which are hereby incorporated by reference in their entirety, there is disclosed a combination display case and storage safe or housing. When the items are not on display, the display case is lowered into the housing for additional security. Oftentimes, access into the housing is required and, therefore, the housing typically includes any number of panels that can be opened to provide such access. Nonetheless, neither patent provides a secure locking mechanism that locks the panels to one another and to the housing, itself.

While each of the devices disclosed above are suitable for the uses and problems they solve, there is an ongoing need for improvements in a locking mechanism being incorporated into such security display cases.

Accordingly, it would be advantageous to provide a security display case which protects merchandise from possible theft without requiring the merchandise to be relocated for safe storage before and after business hours.

It is to this to which the present invention is directed.

SUMMARY OF THE INVENTION

In a first aspect, the present invention provides a locking mechanism comprising: (a) an elongated band; (b) at least one plate rotatably connected to the elongated band; (c) at least one rod rotatably connected to the at least one plate; (d) means for actuating for actuating the locking mechanism, the means for actuating operable between a locking position and an unlocking position for translating the elongated band; (e) a stabilizing member, the stabilizing member maintaining the at least one rod in a substantially horizontal position; and (f) a receptor, the receptor including at least one receptor opening formed therein for receiving the rod.

In a second aspect, the locking mechanism hereof is deployed in conjunction with a storage safe or housing for a display case, the housing, itself, comprising: (a) a plurality of walls defining a substantially enclosed interior; (b) a frame defining a cutout formed within one of the plurality of walls of the housing; and (c) a first door and a second door, the first and second doors form fitted over the cutout and hingedly secured to the frame, the first and second doors each comprising at least one panel having a front surface and a back surface.

The means for actuating, the elongated band, the at least one plate, and the at least one rod are located on the interior surface of the first door while the receptor is mounted on the interior surface of the second door.

The means for actuating, preferably, comprises a key actuated lock including a cylinder, the cylinder including a key receiving end and an opposed locking end. The cylinder extends through the first door of the housing and is accessible from both sides thereof. The lock further comprises a latch projecting radially and outwardly from the locking end of the cylinder and a lever rotatably interconnecting both the latch and the elongated band.

In use, as a user inserts a key into the key receiving end of the lock and turns the key, the cylinder rotates therewith. This action rotates the locking end of the lock and the latch, thereby lifting the lever upwardly or downwardly and, simultaneously, the elongated band in a corresponding direction.

As the elongated band translates, preferably in a vertical direction, the at least one plate rotatably connected thereto rotates in a corresponding direction and facilitates the horizontal translation of the at least one rod. The at least one rod then extends or retracts based on the movement of the elongated band in order to engage the receptor on the opposed door when the doors are in the closed position, thereby locking the doors in place.

For a more complete understanding of the present invention, reference is made to the following detailed description and accompanying drawing. In the drawing, like reference characters refer to like parts throughout the several views in which:

DETAILED DESCRIPTION OF THE INVENTION

As noted hereinabove and in a first aspect hereof, the locking mechanism of the present invention comprises: (a)

an elongated band; (b) at least one plate rotatably connected to the elongated band; (c) at least one rod rotatably connected to the at least one plate; (d) means for actuating for actuating the locking mechanism; (e) a stabilizing member for maintaining the at least one rod in a substantially horizontal position; and (f) a receptor including at least one receptor opening formed therein.

In a second aspect hereof, the above locking mechanism 8 is deployed in conjunction with a storage safe or housing 10 for a display case 10', such as those disclosed in disclosed and claimed in the aforementioned U.S. Pat. Nos. 9,078,531 and 9,512,663, the display case 10 being movable between a raised and a lowered position within the housing 10.

Figure 1:
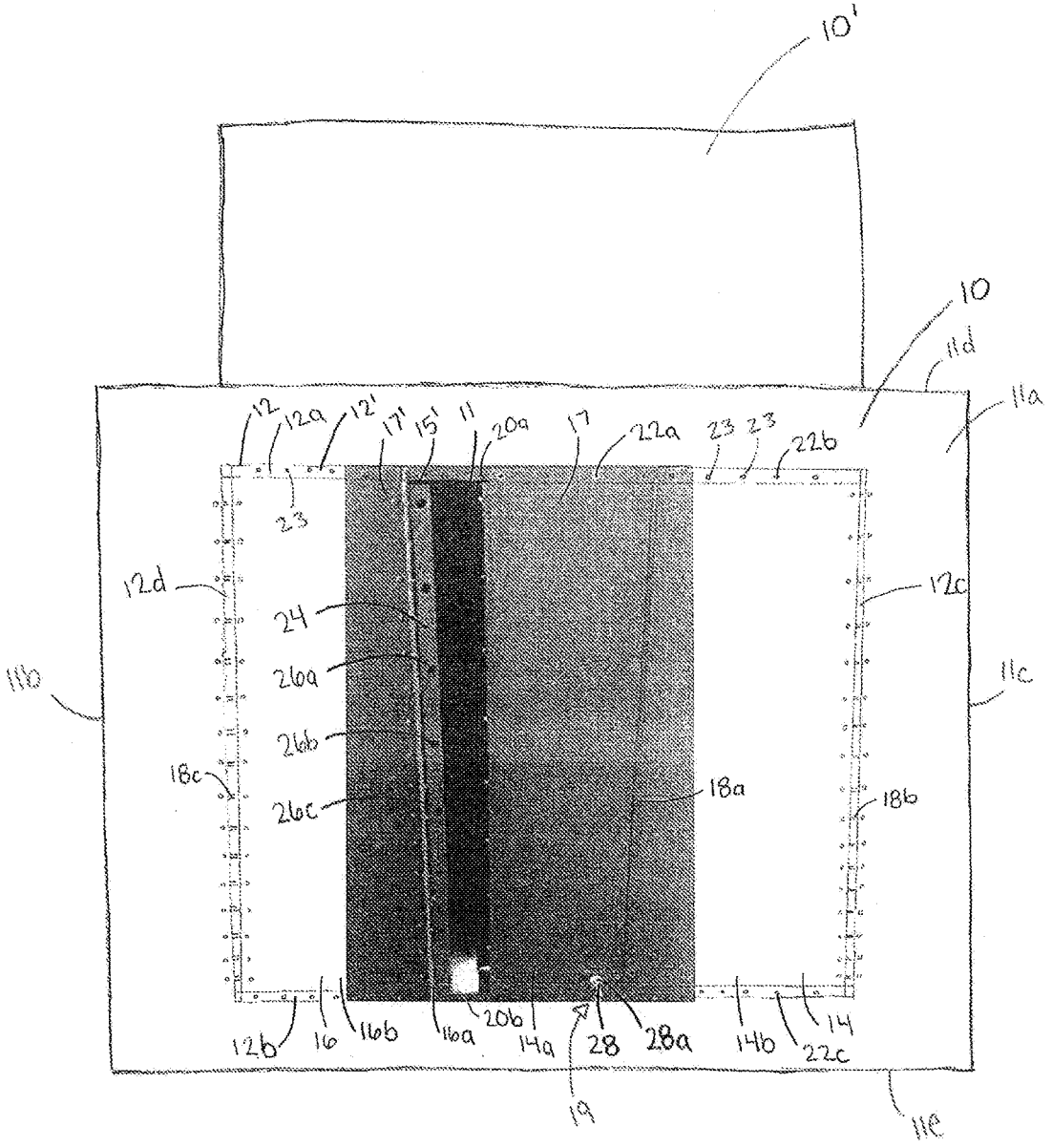
FIG. 1 is a rear view of a locking mechanism disposed on a storage safe with one panel in an open position.
Figure 2:
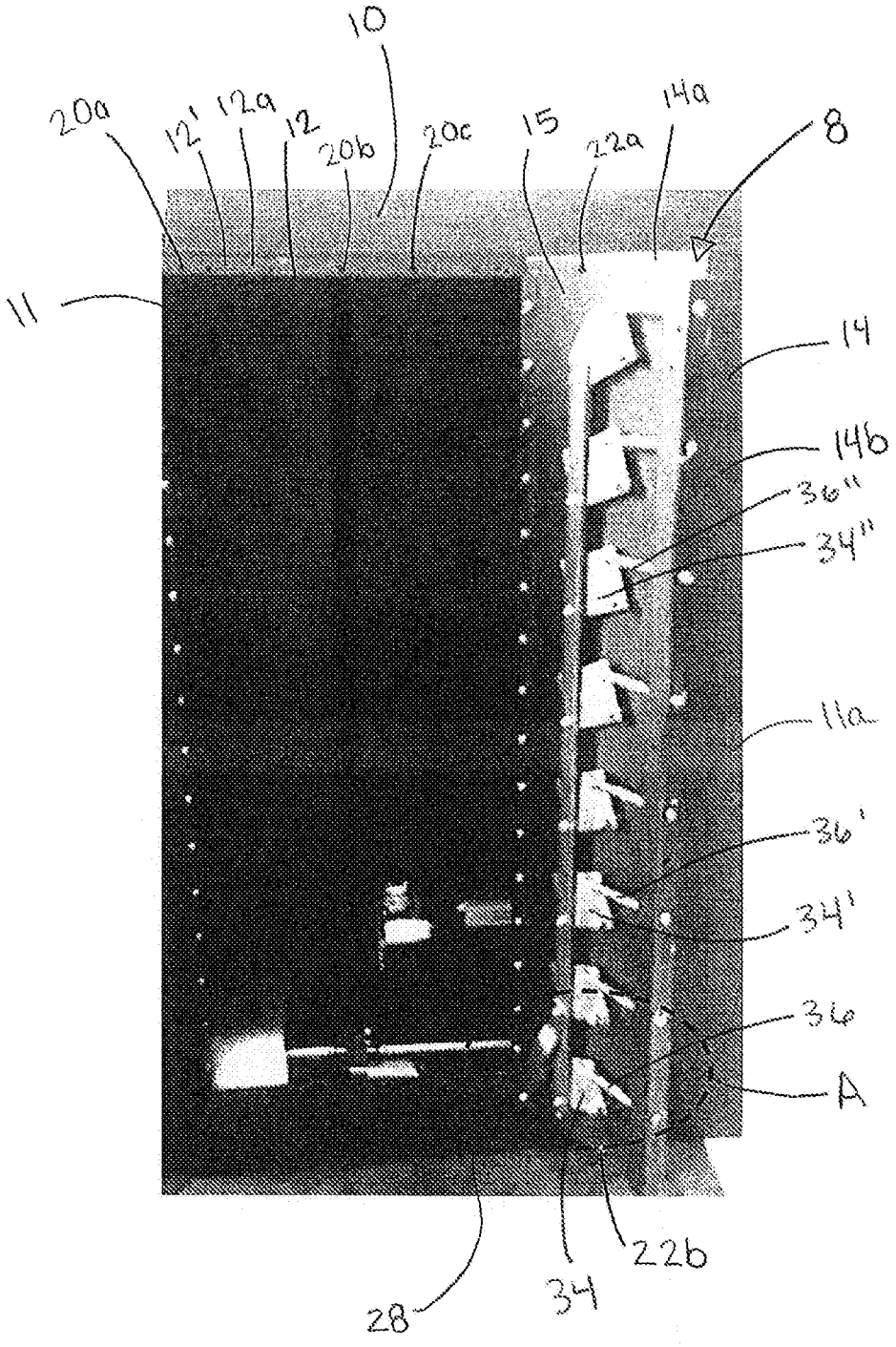
FIG. 2 is a side view of the locking mechanism thereof with two panels in an open position.
Figure 3:
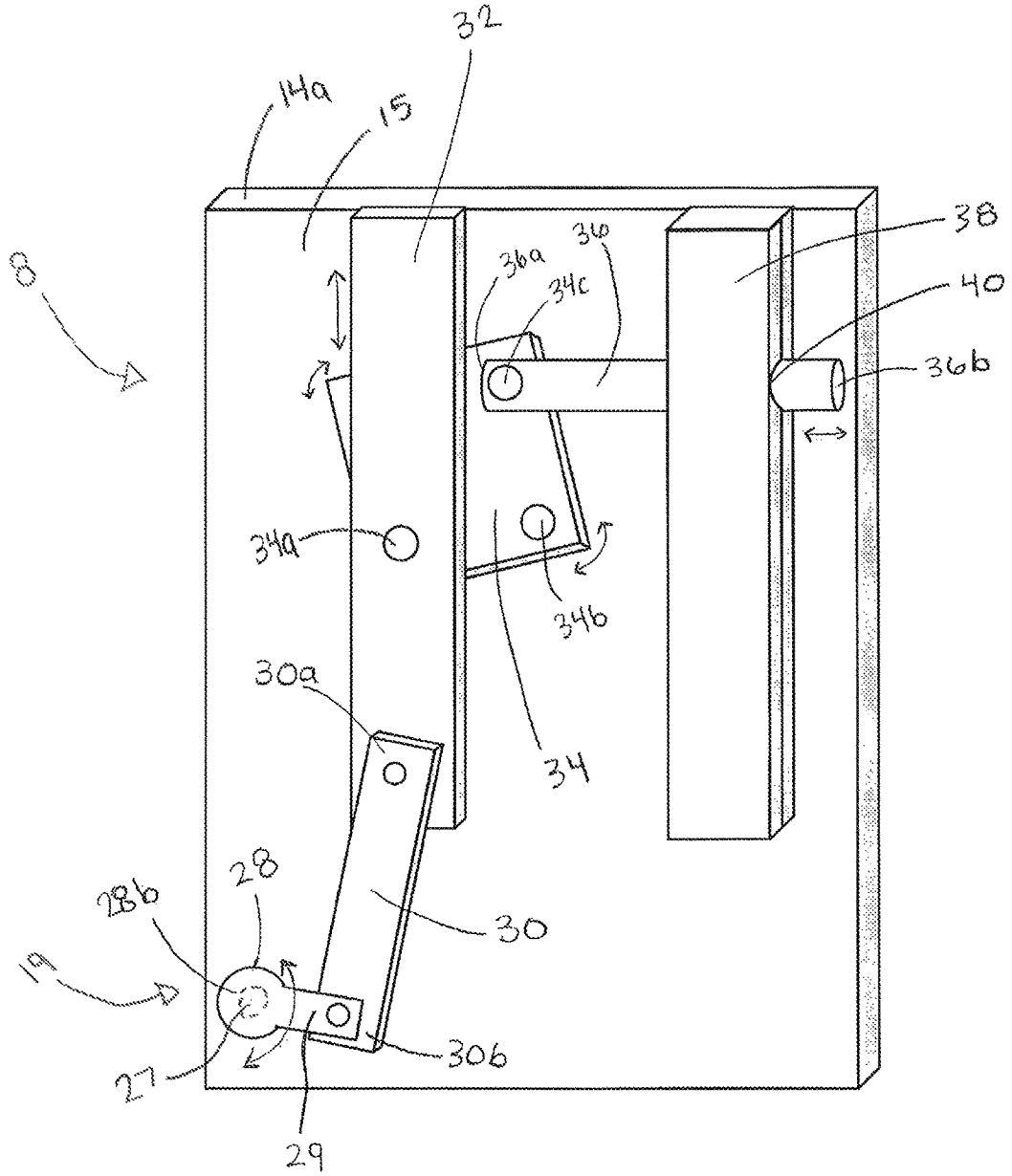
FIG. 3 is an enlarged front view of the locking mechanism thereof as shown in circle A in FIG. 2.

With more particularity and referring to FIGS. 1-3, the locking mechanism 8 is shown mounted to the housing 10. The housing 10 includes a substantially enclosed interior 11 defined by a plurality of walls 11*a*, 11*b*, 11*c*, 11*d*, 11*e*. The housing 10 further includes a frame 12' which defines a cutout 12 formed in any of walls 11*a*, 11*b*, 11*c*. The frame 12' includes a top edge 12*a*, a bottom edge 12*b*, and a pair of opposed side edges 12*c*, 12*d*. The cutout 12 provides access to the interior 11 of the housing 10 and to the display case 10' when it is lowered into the housing 10.

A first door 14 and a second door 16, which are form fitted to the cutout 12, are hingedly mounted to the side edges 12*c*, 12*d*, respectively, of the frame 12'. Each door 14, 16, preferably, comprises at least one panel. Preferably, each door 14, 16 comprises a respective first panel 14*a*, 16*a* and a respective second panel 14*b*, 16*b*. Although, it is to be understood that each door 14, 16 may comprise any number of panels without deviating from the scope of the present invention.

Each panel 14*a*, 14*b* of the first door 16 includes an interior surface 15 and an exterior surface 17. Similarly, each panel 16*a*, 16*b* of the second door 16 includes an interior surface 15' and an exterior surface 17' as well. The first panels 14*a*, 16*a* are hingedly attached to an associated, adjacent second panel 14*b*, 16*b* of the same door via hinges 18*a*, 18*b*, 18*c*, etc. to provide a multi-paneled door. Alternatively, it is to be understood that each door 14, 16 may comprise a single panel without deviating from the scope of the present invention.

The locking mechanism 8 hereof, when employed with the present storage case or housing 10, enables the doors 14, 16 to be securely locked together when closed.

The locking mechanism 8 itself includes a vertically extending elongated band 32 coupled to the interior surface 15 of the first panel 14*a* of the first door 14. The elongated band 32 is a planar member which is translatable between an upper and a lower position, as detailed below. It is to be understood that the elongated band 32 may also be horizontally disposed and horizontally translatable without deviating from the scope of the present invention.

The locking mechanism 8 further comprises at least one plate 34 rotatably connected to the elongated band 32 and the first panel 14*a* of the first door 14. The at least one plate 34 includes a first pivot 34*a*, a second pivot 34*b*, and a third pivot 34*c*. Each pivot 34*a*, 34*b*, 34*c* comprises a fastener such as a rivet, a nut and bolt assembly, or the like which allows the plate 34 to rotate therearound and pivot accordingly. The first pivot 34*a* secures the plate 34 to the elongated band 32. The second pivot 34*b* secures the plate 34 to the interior surface 15 of the first panel 14*a*, thereby creating a fixed point of rotation for the plate 34 to rotate therearound. The third pivot 34*c* secures a rod 36 to the plate 34 and is located above the second pivot 34*b* for purposes described hereinbelow.

The locking mechanism 8 preferably comprises a plurality of equidistantly spaced apart and co-axial plates 34, 34', 34", etc. rotatably connected to the elongated band 32 in the same manner described above.

As noted above, the locking mechanism 8 further comprises at least one rod 36 having a first end 36*a* and an opposed second end 36*b*. The rod 36 is rotatably connected to the plate 34 via the third pivot 34*c* proximate the first end 36*a* of the rod 36. The rod 36 is maintained in a substantially horizontal position, perpendicular to the elongated band 32, as the second end 36*b* of the rod 36 is positioned within a stabilization member 38.

Where a plurality of plates 34, 34', 34", etc. is employed, it is understood that each one of the plurality of plates 34, 34', 34", etc. includes an associated rod 36 rotatably connected thereto.

In order to actuate the at least one rod 36 between extended and retracted positions, the locking mechanism 8 comprises means for actuating 19 for actuating the locking mechanism 8. The means for actuating 19 is operable between a locking position and an unlocking position in order to facilitate the vertical movement of the elongated band 32 and, thus, effectuate horizontal translation of the at least one rod 36, as described below.

The means for actuating 19 can be any suitable device such as a key actuated lock, a manual crank, an electric motor, the motor being AC or DC, or the like.

The means for actuating 19, preferably, comprises a key actuated lock 28 including a cylinder 27. The cylinder 27 includes a key receiving end 28*a* disposed on one end of the cylinder 27 and a locking end 28*b* disposed on the opposed end of the cylinder 27. The lock 28 further includes a latch 29 fixedly secured to the locking end 28*b* of the cylinder 27 and projecting radially and outwardly therefrom.

The means for actuating 19 further comprises a lever 30 rotatably interconnecting the lock 28 and the elongated band 32. The lever 30 includes a first end 30*a* and a second end 30*b*, the first end 30*a* of the lever 30 being rotatably connected to the latch 29. The lever 30 is further rotatably connected to the elongated band 32 proximate the second end 30*b* of the lever 30.

When installed within the housing 10, the lock 28 extends through the first door 14 such that the key receiving end 28*a* is accessible from the exterior surface 17 of the first door 14 and the locking end 28*b* is accessible from the interior surface 15 of the first door 14. The lock 28 is operated by a key in the manner described below.

As noted above, the locking mechanism 8 further comprises a stabilizing member 38 in order to maintain the rod 36 in a substantially horizontal position. While it is understood that the stabilizing member 38 can exhibit a variety of configurations, preferably, the stabilizing member 38 is an elongated member vertically disposed and secured to the interior surface 15 of the first panel 14*a* of the first door 14, or at least on the same panel as the rod 36. At least one stabilizing member opening 40 is formed within the stabilizing member 38 in the same axial plane as the rod 36. The stabilizing member 38 ensures substantially horizontal translation of the rod 36 and that the rod 36 aligns with the receptor opening 26*a* to prevent the doors 14, 16 from swinging open and, thereby, locking the doors 14, 16, to the housing 10 as described below. The second end 36*b* of the rod 36 is positioned within the stabilizing member opening 40 and at no point during operation does the rod 36 ever completely retract out of the stabilizing member opening 40.

Where a plurality of plates 34, 34', 34", etc. and a plurality of rods 36, 36', 36", etc. are employed, the stabilizing member 38 includes a plurality of stabilizing member openings 40, each stabilizing member opening 40 being in registry with an associated rod 36.

As shown in FIG. 1, a receptor 24 is fixedly, vertically mounted to the interior surface 15' of the second door 16 opposite the stabilization member 38. The receptor 24 is an elongated element including at least one receptor opening 26*a* in registry and axially aligned with the at least one rod 36 and the stabilizing member opening 40. Preferably, the receptor 24 is disposed opposite side edge 12*d* of the frame 12' such that the rod 36 can engage the receptor 24 when actuated. Thus, when the first door 14 and second door 16 are closed, the stabilizing member 38 and receptor 24 are, preferably, in close proximity with one another based on the length of the rod 36 to facilitate this engagement.

Where a plurality of rods 36, 36', 36", etc. is employed, the receptor 24 also includes a plurality of axially spaced apart receptor openings 26*a*, 26*b*, 26*c*, etc. each in registry with an associated rod 36 and an associated stabilizing member opening 40.

As the rods 36, 36', 36", etc. translate horizontally, the second end 36*b* of each rod 36 is received within an associated receptor opening 26*a*, 26*b*, 26*c*, etc. and retained therewithin until retracted.

In use, a user inserts a key (not shown) into the key receiving end 28*a* of the lock 28 and turns the key in a first direction into a locking position. As the key is turned, the cylinder 27 rotates the locking end 28*b* of the lock 28 and the latch 29 in a counterclockwise direction, thereby raising the lever 30 upwardly and, simultaneously, lifting the elongated band 32.

In this locking position, where a plurality of plates 34, 34', 34", etc. are utilized, the elongated band 32 is translated upwardly causing the plates 34, 34', 34", etc., which are rotatably connected thereto, to pivot about a respective second pivot 34*b* and rotate in a clockwise direction due to the second pivot 34*b* being lower than the third pivot 34*c*. As the plates 34, 34', 34", etc. pivot, the associated rods 36, 36', 36", etc. are translated horizontally. The rods 36, 36', 36", etc. each maintain a substantially horizontal orientation as a result of the rods 36, 36', 36", etc. being positioned within an associated stabilizing member opening 40.

As the rods 36, 36', 36", etc. extend toward the receptor 24, the second end 36*b* of each respective rod, 36', 36", etc. extends through an associated receptor opening 26*b*, 26*c*, etc., thereby locking the doors 14, 16 in place.

Conversely, the user unlocks the doors 14, 16 by inserting the key into the key receiving end 28*a* of the lock 28 and turning the key in a second, opposite direction, thereby into an unlocking position. As the key is turned in this direction, the cylinder 27 rotates the locking end 28*b* and the latch 29 in a clockwise direction, thereby pulling the lever 30 downwardly and, simultaneously, pulling the elongated band 32 downwardly as well.

In this unlocking position, the elongated band 32 translates downwardly causing each of the plates 34, 34', 34", etc. to pivot at a respective second pivot 34*b* and rotate in a counterclockwise direction. As the plates 34, 34', 34", etc. pivot, the associated rods 36, 36', 36", etc. maintain their horizontal position within the stabilizing member 38. As the rods 36, 36', 36", etc. retract, the second end 36*b* of each of the respective rods 36, 36', 36", etc. is drawn laterally out of an associated receptor opening 26*a*, thereby unlocking the doors 14, 16.

As seen in FIGS. 1 and 2, the top edge 12*a* and the bottom edge 12*b* of the frame 12 may further include a plurality of frame apertures 20*a*, 20*b*, 20*c*, etc. for further securing the doors 14, 16 to the housing 10. Here, the panels 14*a*, 14*b*, 16*a*, 16*b* include a plurality of panel apertures 22*a*, 22*b*, 22*c*, etc. in registry with a plurality of associated frame apertures 20*a*, 20*b*, 20*c*, etc. A plurality of fasteners 23, such as nuts and bolts, screws, or the like, project through the frame apertures 20*a*, 20*b*, 20*c*, etc. and the panel apertures 22*a*, 22*b*, 22*c*, etc. to secure the doors 14, 16 to the housing 10. The fasteners 23 are only accessible to the user once the locking mechanism 8 is unlocked and one of the first panels 14*a*, 16*b* swings open to allow access to the interior 11 of the housing 10.

When either first panel 14*a* or 16*a* is opened, the user is then able to reach into the interior 11 of the housing 10 and individually remove each of the fasteners 23. Once the fasteners 23 on the remaining, secured panels are removed, each panel may be opened as well to provide the user with full access to the interior of the housing 10 and the display case 10' when lowered and stored therein.

When the user desires to close access to the interior 11 of the housing 10, the panels 14*a*, 14*b*, 16*a*, 16*b* are closed and the fasteners 23 are reattached to the frame apertures 20*a*, 20*b*, 20*c*, etc. and panel apertures 22*a*, 22*b*, 22*c*, etc. to secure the panels 14*a*, 14*b*, 16*a*, 16*b* to the housing 10. It should be understood that it is not necessary to provide frame apertures and panel apertures on both first panels 14*a*, 16*a* as any associated fasteners 23 would be impossible to access once both first panels 14*a*, 16*a* are closed. Therefore, only one of the first panels 14*a*, 16*a* need be secured in this manner.

Figure 4:
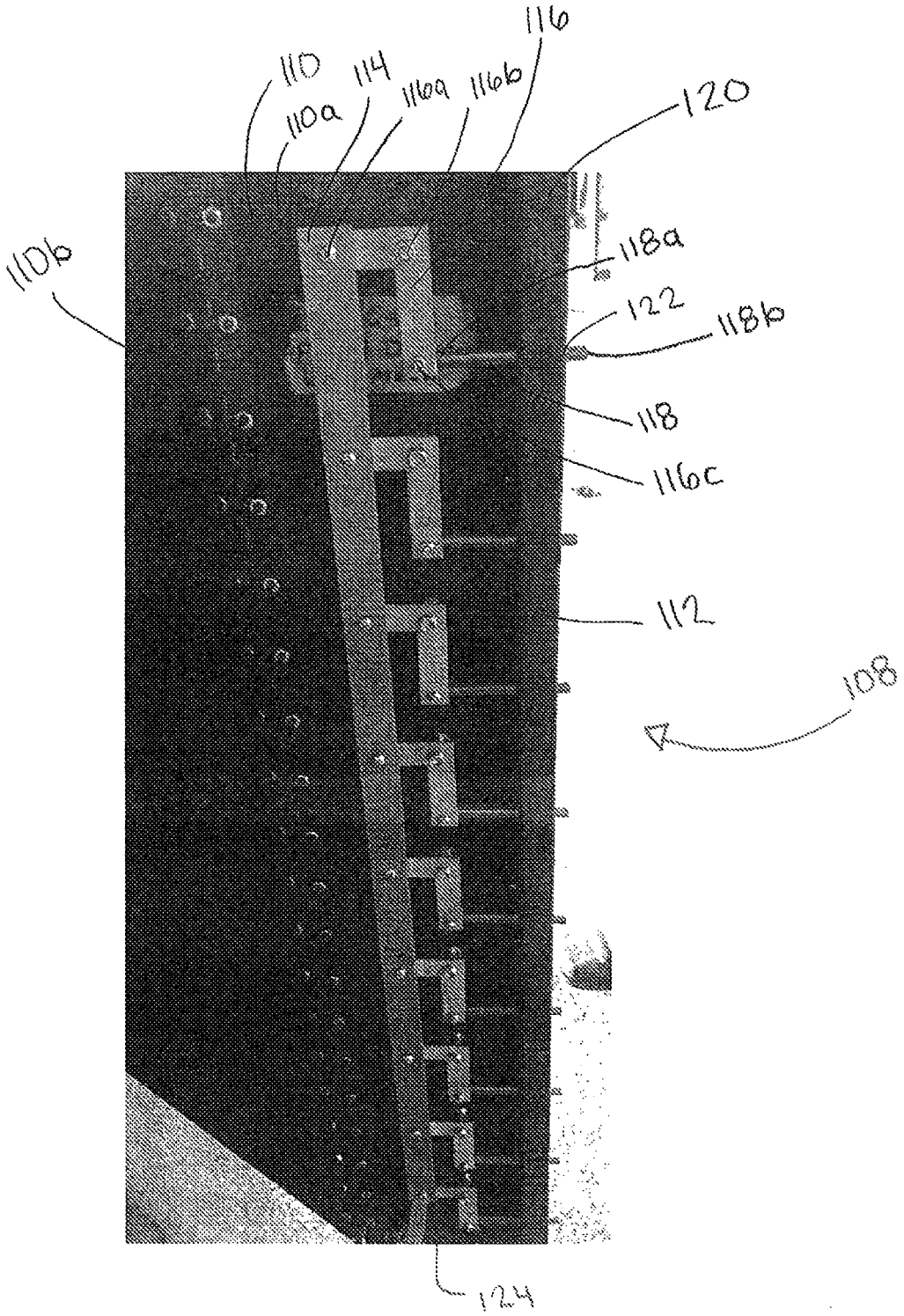
FIG. 4 is a front view of the locking mechanism in an alternative configuration.

With reference to FIG. 4, in an alternative configuration, a locking mechanism 108 comprises an elongated band 114, at least one rod 118, a stabilizing member 120, and means for actuating 124. Each of these components is identical to like components in the locking mechanism 8 described above.

According to this alternative configuration, the locking mechanism further comprises at least one plate 116 having a first pivot 116*a*, a second pivot 116*b*, and a third pivot 116*c* located in a lower plane than the second pivot 116*b*. The at least one plate 116 forms a substantial right angle bracket. The plate 116 is rotatably attached to the elongated band 114 at the first pivot 116*a*, the second pivot 116*b* of the plate 116 is rotatably attached to an interior surface 112 of a first panel 110*a* of a first door 110 to create a fixed point of rotation. The rod 118 is rotatably attached at a first end 118*a* to the third pivot 116*c* of the plate 116.

Here, the plate 116 operates by pivoting about the second pivot 116*b* in an opposite direction than the plate 34 described above due to the second and third pivots 116*b*, 116*c* being in reversed locations respective one another, i.e. the second pivot 116*b* being higher than the third pivot 116*c*.

It is to be understood that there is no requirement that the components of the locking mechanism 8 be disposed on a specified door 14 or 16 as illustrated and described above. If the means for actuating 19, the elongated band 32, the at least one plate 34, the at least one rod 36, and the stabilizing member 38 are located on the second door 16 instead of the first door 14, the components on the second door 16, such as the receptor 24, would instead be located on the opposite first door 14. Here, the plate 34 would pivot in the opposite direction as the elongated band 32 translates vertically.

LIST OF REFERENCE NUMERALS

8 Locking mechanism
10 Housing
10' Display case

11 Interior of housing
11*a* Wall of housing
11*b* Wall of housing
11*c* Wall of housing
11*d* Wall of housing
11*e* Wall of housing
12 Cutout
12' Frame
12*a* Top edge of frame
12*b* Bottom edge of frame
12*c* Right side edge of frame
12*d* Left side edge of frame
14 First door
14*a* First panel of first door
14*b* Second panel of first door
15 Interior surface of first door
15' Interior surface of second door
16 Second door
16*a* First panel of second door
16*b* Second panel of second door
17 Exterior surface of first door
17' Exterior surface of second door
18*a* Hinge
18*b* Hinge
18*c* Hinge
19 Means for actuating
20*a* Frame aperture
20*b* Frame aperture
20*c* Frame aperture
22*a* Panel aperture
22*b* Panel aperture
22*c* Panel aperture
23 Fasteners
24 Receptor
26*a* Receptor opening
26*b* Receptor opening
26*c* Receptor opening
27 Cylinder
28 Key actuated lock
28*a* Key receiving end of lock
28*b* Locking end of lock
29 Latch
30 Lever
30*a* First end of lever
30*b* Second end of lever
32 Elongated band
34 Plate
34' Plate
34" Plate
34*a* First pivot of plate
34*b* Second pivot of plate
34*c* Third pivot of plate
36 Rod
36' Rod
36" Rod
36*a* First end of rod
36*b* Second end of rod
38 Stabilizing member
40 Stabilizing member opening
108 Locking mechanism
110 First door
110*a* First panel of first door
110*b* Second panel of first door
112 Interior surface of first panel of first door
114 Elongated band
116 Plate
116*a* First pivot of plate
116*b* Second pivot of plate
116*c* Third pivot of plate
118 Rod
118*a* First end of rod
118*b* Second end of rod
120 Stabilizing member
122 Stabilizing member opening
124 Means for actuating

Having thus described the invention, what is claimed is:

1. A locking mechanism comprising:
(a) an elongated band;
(b) a plurality of spaced apart plates rotatably connected to the elongated band;
(c) a plurality of spaced apart rods rotatably connected to an associated plate;
each rod being simultaneously horizontally rotatable and retractable in the same direction;
(d) means for actuating for actuating the locking mechanism, the means for actuating operable between a locking position and an unlocking position for translating the elongated band, the means for actuating including a lock and a lever, the lever having a first end and a second end, the first end of the lever being operably connected to the lock, the second end of the lever being rotatably connected to the elongated band and causing translation thereof;
(e) at least one stabilizing member, the at least one stabilizing member maintaining the plurality of spaced apart rods in a substantially horizontal position; and
(f) a receptor, the receptor including a plurality of receptor openings formed therein for receiving the rods.

2. The locking mechanism of claim 1 further comprising:
(a) a housing, the housing including:
(i) a plurality of walls defining a substantially enclosed interior;
(ii) a frame having a top edge, a bottom edge, and a pair of opposed side edges, the frame defining a cutout formed within one of the plurality of walls;
(iii) a first door and a second door form fitted over the cutout and hingedly secured to respective side edges of the frame, the first and second doors each comprising at least one panel having a front surface and a back surface;
wherein the at least one plates, the means for actuating, and the stabilizing member are disposed on the back surface of the at least one panel of the first door, the at least one plate rotatably connected to the at least one panel of the first door, the means for actuating being accessible from the front surface of the at least one panel of the first door; and
further wherein the receptor is disposed on the back surface of the at least one panel of the second door.

3. The locking mechanism of claim 2 wherein the plurality of plates are axially and equidistantly spaced apart from one another along the elongated band.

4. The locking mechanism of claim 3 wherein each one of the plurality of rods is associated with and in registry with an associated one of a plurality of stabilizing member openings formed within the stabilizing member.

5. The locking mechanism of claim 1 wherein the lock is a key actuated lock, the lock comprising:
(a) a cylinder including a key receiving end and an opposed locking end;
(b) a latch having a first end and a second end, the first end of the latch being secured to the locking end of the cylinder and projecting radially and outwardly therefrom, and wherein the lever has a first end and a second end, the first end of the lever being rotatably connected to the second end of the latch and extending upwardly therefrom, the second end of the lever being rotatably connected to the elongated band; and further wherein operating the means for actuating between an unlocking position and a locking position translates the elongated band in respective directions.

6. The locking mechanism of claim 1 wherein each plate forms a substantially right angle bracket rotatably connected to the elongated band.

7. The locking mechanism of claim 2 wherein the first and second doors of the housing are secured to the housing by a plurality of fasteners insertable into a plurality of respective frame apertures formed within the top edge and the bottom edge of the frame and a plurality of respective panel apertures formed in each of the at least one panels of the first and second doors, each one of the plurality of frame apertures being in registry with an associated one of the plurality of panel apertures.

8. A storage case comprising:

(a) a housing including:

(i) a plurality of walls defining a substantially enclosed interior;

(ii) a frame having a top edge, a bottom edge, and a pair of opposed side edges, the frame defining a cutout formed within one of the plurality of walls;

(iii) a first door and a second door form fitted over the cutout and hingedly secured to respective side edges of the frame, the first and second doors each comprising at least one panel having a front surface and a back surface;

(b) a locking mechanism including:

(i) an elongated band;

(ii) a plurality of spaced apart plates rotatably connected to the elongated band;

(iii) a plurality of spaced apart rods rotatably connected to an associated plate; each rod being simultaneously horizontally rotatable and retractable in the same direction;

(iv) means for actuating for actuating the locking mechanism, the means for actuating operable between a locking position and an unlocking position for translating the elongated band, the means for actuating including a lock and a lever, the lever having a first end and a second end, the first end of the lever being operably connected to the lock, the second end of the lever being rotatably connected to the elongated band and causing translation thereof;

(v) at least one stabilizing member, the at least one stabilizing member maintaining the plurality of spaced apart rods in a substantially horizontal position;

(vi) a receptor, the receptor including a plurality of receptor openings formed therein for receiving the rods;

wherein the plates, the means for actuating, and the stabilizing member are disposed on the back surface of the at least one panel of the first door, the plates rotatably connected to the at least one panel of the first door, the means for actuating being accessible from the front surface of the at least one panel of the first door; and further wherein the receptor is disposed on the back surface of the at least one panel of the second door.

9. A storage case comprising:

(a) a housing including:

(i) a plurality of walls defining a substantially enclosed interior;

(ii) a display case movable between a raised and a lowered position within the interior thereof;

(iii) a frame having a top edge, a bottom edge, and a pair of opposed side edges, the frame defining a cutout formed within one of the plurality of walls;

(iv) a first door and a second door form fitted over the cutout and hingedly secured to respective side edges of the frame, the first and second doors each comprising at least one panel having a front surface and a back surface;

(b) a locking mechanism including:

(i) an elongated band;

(ii) a plurality of spaced apart plates rotatably connected to the elongated band;

(iii) a plurality of spaced apart rods rotatably connected to an associated plate; each rod being simultaneously horizontally rotatable and retractable in the same direction;

(iv) means for actuating for actuating the locking mechanism, the means for actuating operable between a locking position and an unlocking position for translating the elongated band, the means for actuating including a lock and a lever, the lever having a first end and a second end, the first end of the lever being operably connected to the lock, the second end of the lever being rotatably connected to the elongated band and causing translation thereof;

(v) at least one stabilizing member, the at least one stabilizing member maintaining the plurality of spaced apart rods in a substantially horizontal position;

(vi) a receptor, the receptor including a plurality of receptor openings formed therein for receiving the rods;

wherein the plates the means for actuating, and the stabilizing member are disposed on the back surface of the at least one panel of the first door, the plates rotatably connected to the at least one panel of the first door, the means for actuating being accessible from the front surface of the at least one panel of the first door; and further wherein the receptor is disposed on the back surface of the at least one panel of the second door.

* * * * *